United States Patent [19]

Niehaus et al.

[11] 4,042,227

[45] Aug. 16, 1977

[54] METHOD AND APPARATUS FOR CONTINUOUSLY HOMOGENIZING AND QUENCHING ALUMINUM BILLETS

[75] Inventors: Howard E. Niehaus; Winfield M. Hass; Homer G. Alpha, all of Owensboro, Ky.; Sidney B. Hall, Tiburon, Calif.; Frederick O. Traenkner, Pittsburgh, Pa.

[73] Assignees: Southwire Company, Carrollton, Ga.; National Steel Corporation, Pittsburgh, Pa.

[21] Appl. No.: 598,236

[22] Filed: July 23, 1975

Related U.S. Application Data

[63] Continuation-in-part of Ser. No. 344,626, March 26, 1973, abandoned.

[51] Int. Cl.[2] ..... C21D 9/08

[52] U.S. Cl. ..... 266/93; 134/64 R; 148/153; 266/114; 266/117

[58] Field of Search ..... 134/64 R; 148/153; 266/93, 113, 114, 117

[56] References Cited

U.S. PATENT DOCUMENTS

| | | | |
|---|---|---|---|
| 2,747,587 | 5/1956 | Strachan | 266/93 X |
| 3,300,198 | 1/1967 | Clumpner et al. | 134/64 |
| 3,671,028 | 6/1972 | Hemsath | 266/134 |
| 3,698,700 | 10/1972 | Ziehm et al. | 134/64 |

FOREIGN PATENT DOCUMENTS

| | | | |
|---|---|---|---|
| 159,556 | 2/1961 | U.S.S.R. | 266/114 |

*Primary Examiner*—Roy Lake
*Assistant Examiner*—Paul A. Bell
*Attorney, Agent, or Firm*—Van C. Wilks; Herbert M. Hanegan; Stanley L. Tate

[57] ABSTRACT

This disclosure relates to a method and apparatus for continuously homogenizing and quenching aluminum billets in an in-line tandem system. The billets are conveyed into a furnace and transported through a series of stages therein where they are heated to obtain a uniform crystalline structure, and then immediately conveyed into and through a quench chamber where they are rapidly cooled to obtain improved metallurgical properties. The quench chamber includes a series of ring-shaped spray headers having a plurality of spray nozzles disposed thereabout for emitting a cooling fluid evenly about the billets as they pass through the rings in order to prevent warpage. The spray rings are vertically adjustable by means of a common linkage so that they will be concentric with respect to the longitudinal axes of billets of different diameters adapted to pass therethrough. Valve means are provided for each of the spray rings for varying the degree of quench from the inlet to the outlet of the chamber in order to obtain a permanent set with a quick quench as the billet enters the chamber. Warpage is further inhibited by controlling the rate of billet travel through the chamber.

14 Claims, 9 Drawing Figures

METHOD AND APPARATUS FOR CONTINUOUSLY HOMOGENIZING AND QUENCHING ALUMINUM BILLETS

CROSS-REFERENCE TO RELATED APPLICATION

This application is a continuation-in-part of copending application Ser. No. 344,626, filed Mar. 26, 1973, now abandoned.

BACKGROUND OF THE INVENTION

This invention relates generally to the metal treating art, and more particularly to the production of aluminum billets which may be subsequently processed in an extrusion operation to form elongated shapes such as electrically conductive rod and wire, as well as other articles.

Cast metal billets, particularly billets cast from aluminum and aluminum alloys, are generally heat-treated prior to extrusion in order to homogenize, or render more uniform, the crystalline structure thereof. This operation is, of course, well known to those skilled in the art, and the particular treating temperatures and immersion times are functions of the particular billet size and constituency.

Subsequent to the homogenizing operation, the billets must be quenched in order both to facilitate handling as well as to improve the metallurgical properties thereof. A primary concern in the quenching of billets that are to be subsequently extruded, however, is that the billets do not warp to such an extent that they cannot be processed through the dies of an extrusion apparatus. To this end, certain allowable warp standards or straightness tolerances have been established in the industry, as follows:

5⅛ inches to 8 inches diameter billets —
maximum allowable lateral bow is ⅛ inch in a length of 3½ times the billet diameter;
9 inches to 12 inches diameter billet —
maximum allowable lateral bow is 3/16 inch in a length of 3 ½ times the billet diameter.

As the degree of warp is, at least to some extent, a function of the rapidity of the quenching operation, slow air cooling has been used in the prior art as one method of limiting the degree of warp. However, air cooling is, of course, very time consuming and does not lend itself to a continuous production operation.

At the other extreme, some prior art systems utilized a complete immersion of the billets in a water bath. The drastic temperature gradients, however, invariably caused severe bending and bowing of the billets.

Between these extremes, other prior art quench systems utilized batch-cooling techniques in which a mass of billets was sprayed with water while large fans passed air thereover. This method did not cool the metal uniformly and thus resulted in billets of poor quality that, in many instances, had to be rejected. Moreover, spraying of water against only one side of the billets increased the temperature gradients thereacross and thus further exacerbated the warp problem.

SUMMARY OF THE INVENTION

In view of the foregoing, it should be apparent that there is still a need in this art for a system for continuous heating and quenching of aluminum billets that will yield a billet having suitable metallurgical and geometrical characteristics so as to facilitate a subsequent extrusion operation.

It is, therefore, a primary object of this invention to provide a method and apparatus for continuously and rapidly quenching homogenized metal billets in such a manner as to limit the degree of warp thereof.

More particularly, it is an object of this invention to provide a method and apparatus for continuously and rapidly quenching homogenized metal billets so as to limit the degree of warp to less than approximately one-half the industry-accepted warp standards.

Yet another object of this invention is to provide an apparatus whereby metal billets can be stored, transported , homogenized, quenched and readied for shipment in one continuous, substantially automated operation requiring minimum manpower and handling.

A further object of this invention is to provide apparatus as above described wherein the billets are quenched in a quench chamber having a plurality of circular spray headers, and wherein means are provided for adjusting the position of the spray headers so that billets passing therethrough will be evenly cooled about their entire peripheries.

Still another object of this invention is to provide a method and apparatus as above-described whereby the admission of cooling fluid to the spray headers may be selectively controlled so that a quick quench may be obtained as the billet just enters the quench chamber for establishing a permanent set in the billet, and the degree of quench thereafter reduced so as to inhibit further warpage.

Briefly, these and other objects of the invention that may become apparent hereinafter are accomplished in accordance with this invention by providing a tandem homogenizing and quenching system capable of heating aluminum billets to obtain a uniform crystalline structure and then rapidly and continuously cooling the billets with minimal warp so as to facilitate their passing through the die of an extruding machine in a subsequent extrusion operation.

In one embodiment of the invention, the system includes a homogenizing furnace having a first preheater stage in which the temperature of the billets is raised to 1050° F., and a soaking stage where the billets are held at that temperature for a predetermined interval of time so as to effect uniformity of the metal crystals in the billets. Preferably, the furnace is adapted to handle six 9 inches diameter by 25 foot long billets per hour in the pre-heater stage, and for holding a mass of billets for six hours in the soaking stage. It should be understood, however, that these criteria form no part of the invention, and that the use of other homogenizing furnaces having different capacities and design characteristics is contemplated within the scope of the invention.

After the homogenizing operation is completed, the billets are immediately conveyed into and through a novel quench chamber where they are cooled to 300° F in approximately 10 minutes to achieve improved metallurgical properties while the warpage is limited to less than one-half the allowable warp standards as set by the industry. This is accomplished in accordance with this invention by providing an elongated quench chamber having a conveyor table extending therethrough along which the billets are advanced axially by means of a series of drive rollers. A plurality of circular spray headers having spray nozzles disposed thereabout are positioned concentrically along the conveyor table and are adapted to emit a spray of cooling fluid evenly about each of the billets as they pass through the spray headers, thus causing the entire circumferential surface of the billets to cool at an equal rate. The drive rollers are preferably hourglass-shaped and are disposed between adjacent ones of each of the plurality of spray headers so as to provide sufficient support for the billets during the quenching thereby inhibiting warpage thereof. Moreover, each of the spray rings is mounted for vertical movement so that they may be concentrically arranged with respect to billets of different diameters adapted to pass therethrough. Owing to this arrangement, the billets may be evenly cooled about their peripheral surfaces thereby further inhibiting warpage thereof. A common linkage is also provided interconnecting each of the spray rings and operable externally of the quench chamber for varying the vertical position of the spray rings.

Each of the spray rings is further provided with valve means for controlling the admission of cooling fluid thereto, the valve means being selectively operable to adjust the volume of fluid admitted into the respective spray ring whereby the degree of quench may be varied throughout the quench chamber. To this end, and in accordance with a method aspect of this invention, the initial spray rings in the quench chamber are adjusted to provide a high volume fluid flow whereby a quick quench may be obtained to yield a permanent set in the billet, and the remaining spray rings are then controlled to apply a lesser degree of quench so as to inhibit warpage of the billet.

With the above and other objects in view that may appear hereinafter, the nature of the invention may be more clearly understood by reference to the several views illustrated in the accompanying drawings, the following detailed description thereof, and the appended claimed subject matter:

DETAILED DESCRIPTION OF A PREFERRED EMBODIMENT

Figure 1:
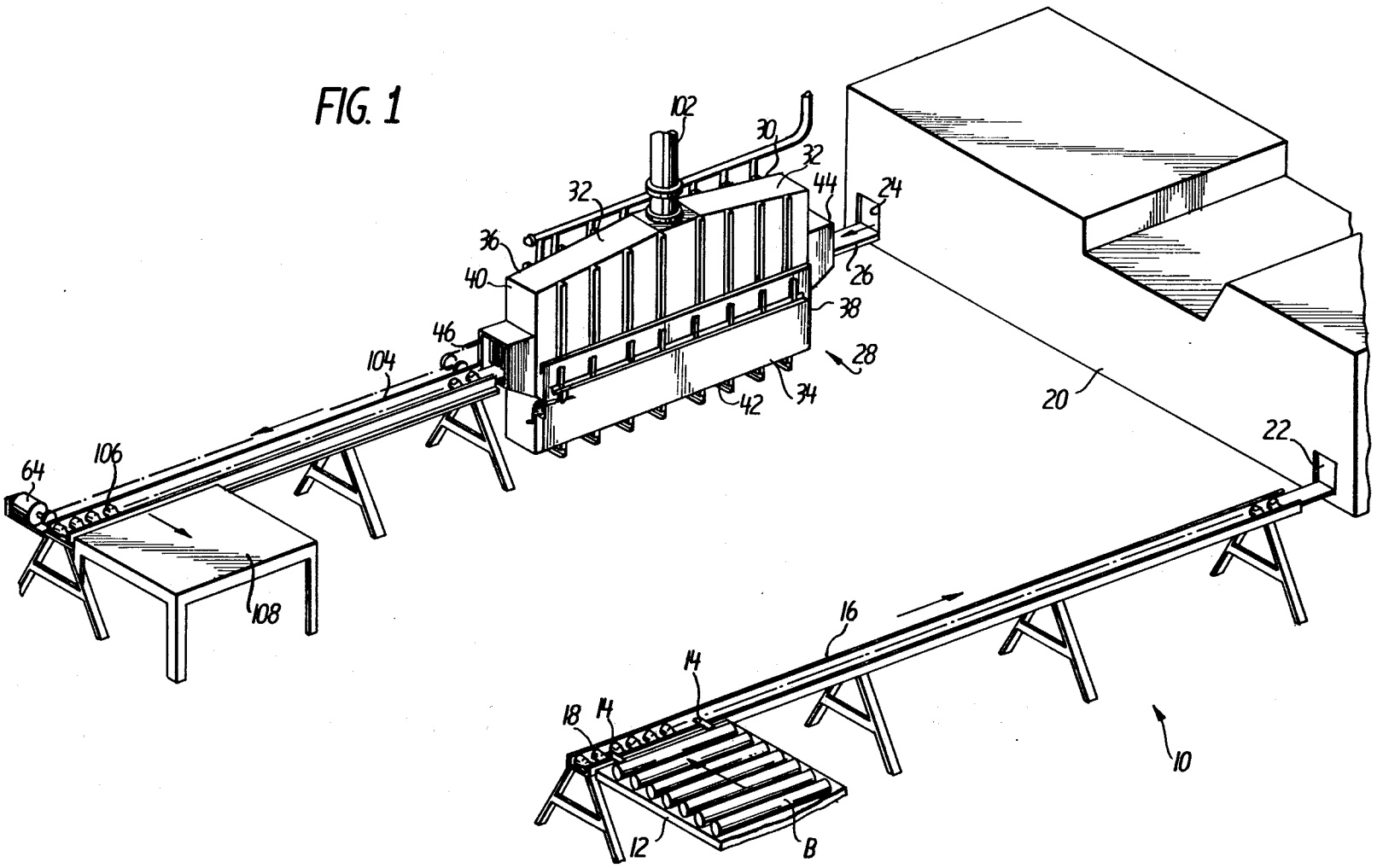
FIG. 1 is a fragmentary perspective view of a metal billet homogenizing and quench system constructed in accordance with this invention, and depicts a loading table, a conveyor for transporting billets through the system, a furnace, a quench chamber, and a discharge table.

Referring now to the drawings in detail, there is illustrated in FIG. 1 a tandem homogenizing and quench system generally designated by the numeral 10. The system 10 includes a laydown table 12 upon which aluminum billets B are loaded preliminary to processing through the system 10. The billets B are advanced along the table 12 by conventional means (not shown) until they approach the front end thereof. At this point, a conventional transfer mechanism 14 is adapted to automatically lift each billet B and roll it onto a charge table 16 equipped with conveyor rollers 18. Suitable drive means (not shown) are adapted to drive the conveyor rollers 18 so as to advance the billets B along the charge table 16 toward a homogenizing furnace 20.

The furnace 20 may be of conventional type such as provided by Sunbeam Equipment Corporation under their Ser. No. F-37-72. The furnace 20 is preferably gas fired and is adapted to heat the billets B to a predetermined homogenizing temperature, preferably about 1050° F., and hold them at that temperature for approximately 6 hours so as to obtain a uniform crystalline structure therein. The billets B are advanced at regular intervals into the furnace 20 through an entrance opening 22 which opens automatically upon approach of a billet B and closes automatically at the start of a heating cycle. The furnace 20 includes a walking beam mechanism (not shown) which automatically transports the billets B through preheater and soaking stages of the furnace 20. After a predetermined interval, a discharge opening 24 automatically opens and the billets B are ejected from the furnace 20 onto a discharge conveyor 26 which transports the billets B into a quench chamber 28 where they are spray cooled to 300° F. in approximately 10 minutes or less.

Figure 2:
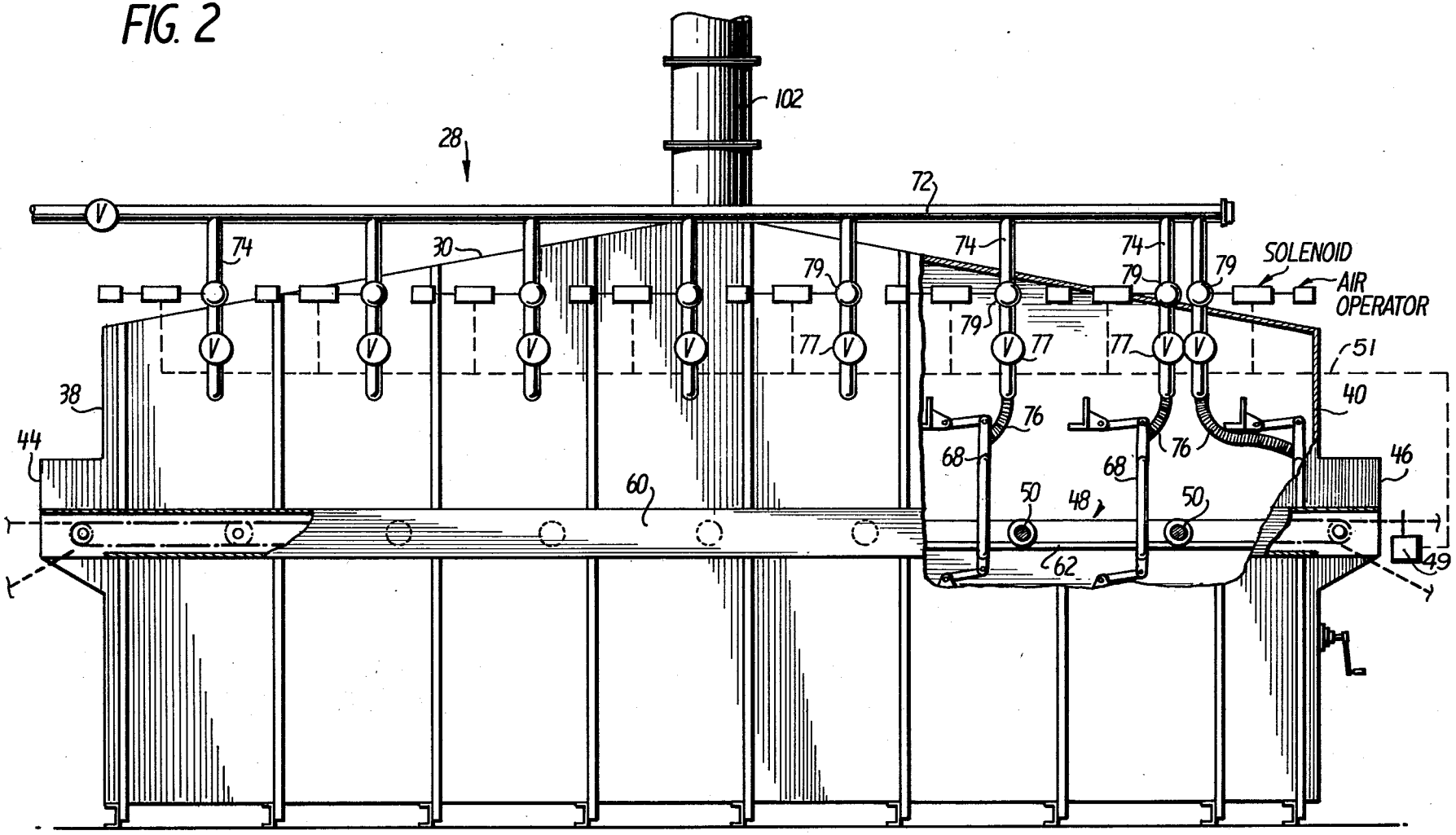
FIG. 2 is a side elevation view of the quench chamber of this invention, portions thereof being cut away for clarity to illustrate the manner in which the cooling fluid is conveyed from a manifold pipe to each of the plurality of adjustable spray rings mounted therein.

The quench chamber 28 includes an elongated housing 30 defined by sloping top walls 32, side walls 34, 36, end walls, 38, 40 and a floor 42. An inlet opening 44 is formed in the end wall 38 for admission of the billets B into the quench chamber 28 and an outlet opening 46 is formed in the end wall 40 for exit of the billets B therefrom. Referring to FIG. 2, a conveyor table 48 comprising a plurality of hour-glass -shaped rollers 59 extends axially through the quench chamber 28 from the inlet opening 44 to the outlet opening 46.

Figure 9:
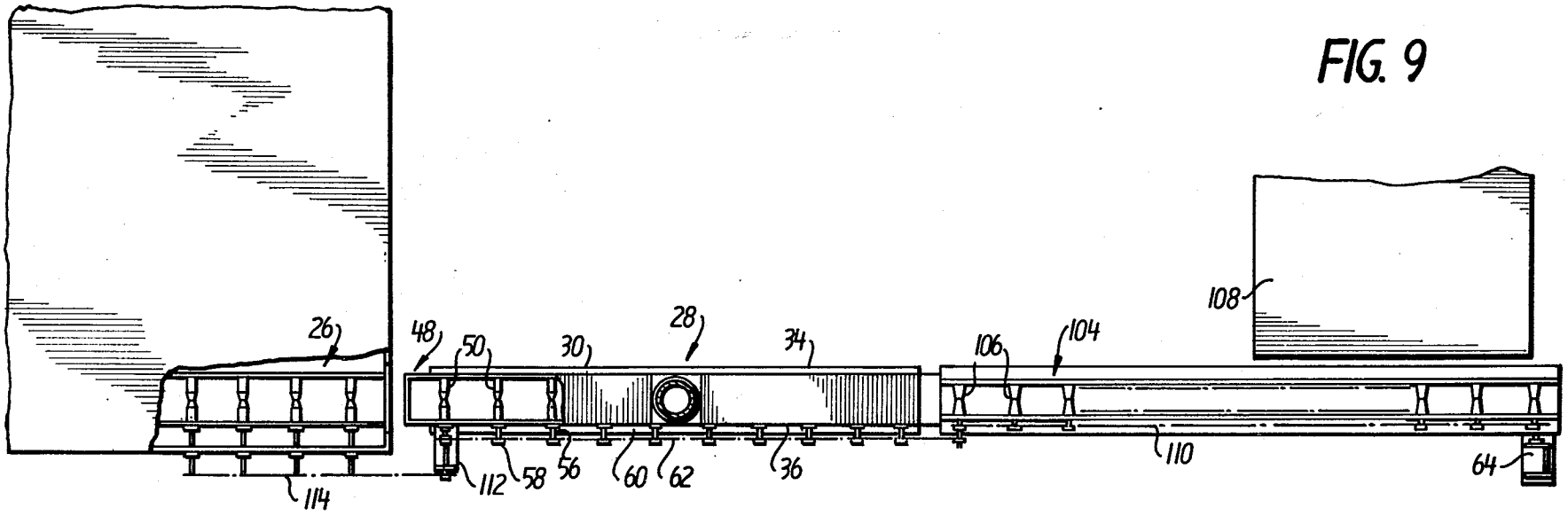
FIG. 9 is a plan view of a portion of the conveyor system of this invention, and depicts the furnace discharge conveyor, the quench chamber conveyor, and the discharge transfer station conveyor, all being interconnected with a single drive means.
Figure 8:
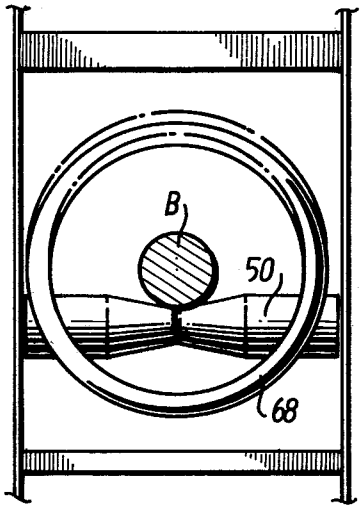
FIGS. 7 and 8 are vertical sectional views taken through the quench chamber, and depict a spray ring adjusted to different positions so as to be concentrically arranged with respect to billets of different diameters passing therethrough.
Figure 7:
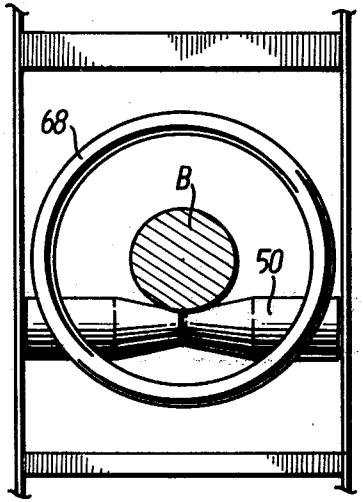

As seen in FIG. 9, each of the rollers 50 is suitably journalled in bearings in the side walls, 34, 36, respectively, of the housing 30. A drive shaft 56 carrying a sprocket wheel 58 extends axially from each of the rollers 50 into a drive housing 60 mounted on the side wall of the housing 30. The rollers 50 are thus rotated by an endless drive chain 62 which extends over the sprocket wheel 58 and which is driven by a variable speed drive motor 64 through a suitable drive train as will be described more fully hereinafter.

Referring again to FIG. 2, a plurality of concentrically arranged circular spray headers or rings 68 are disposed along the length of the conveyor table 48 between each of the rollers 50 so that the path of travel of the billets B extends axially therethrough. Each of the rings 68 includes a plurality of spray nozzles 70 (FIG. 4) disposed about the inner periphery thereof for emitting a spray of cooling fluid onto the billets B passing therethrough. Cooling fluid such as water is conducted to the spray rings 68 from a manifold pipe 72 which extends axially along the extent of the quench chamber housing 30. A plurality of T-branch connecting pipes 74 connect the manifold pipe 72 to each of the spray rings 68 through a suitable flexible coupling 76, such as rubber hose. An adjustable valve 77 is provided in each of the pipes 74 for selectively varying the volume of cooling fluid admitted into each of the spray rings 68.

The water is admitted to the spray rings 68 through a plurality of normally closed, solenoid-controlled, air operated valves 79 which open when a billet B enters the quench chamber 28. A trip switch 49 associated with the conveyor 48 closes when a billet passes thereover to energize, via line 51, the various solenoids (unnumbered) thereby opening the valves 79 and emitting the water spray through the rings 68. A vent stack 102 extends from the top of the housing 30 for exhausting steam from the quench chamber 28.

Figure 3:
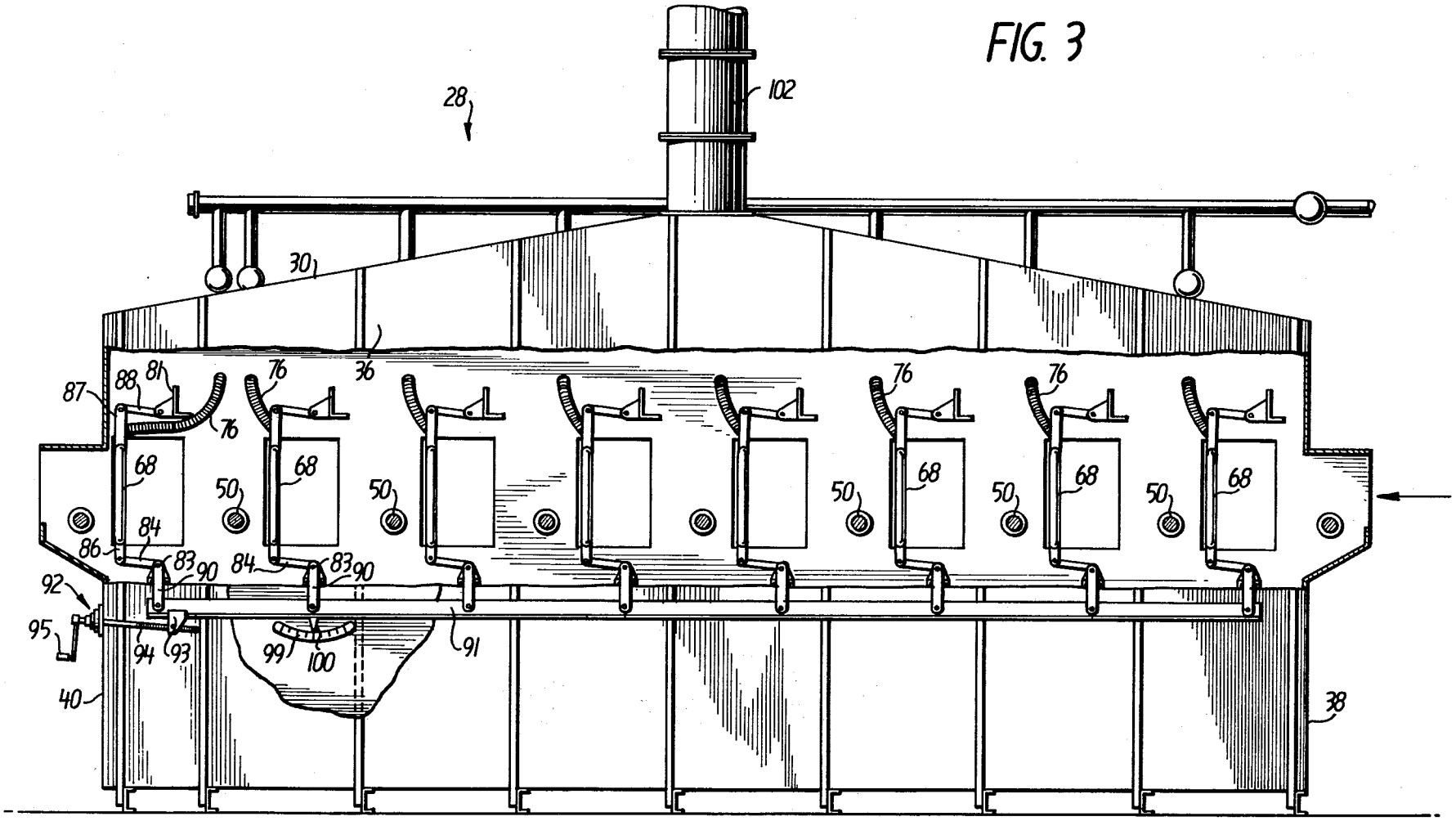
FIG. 3 is a side elevation view of the quench chamber of this invention, taken from the opposite side of the quench chamber as compared with FIG. 2, portions thereof being cut away for clarity to illustrate the adjustably mounted spray rings, as well as the interconnected linkage by means of which the spray rings can be simultaneously adjusted.
Figure 4:
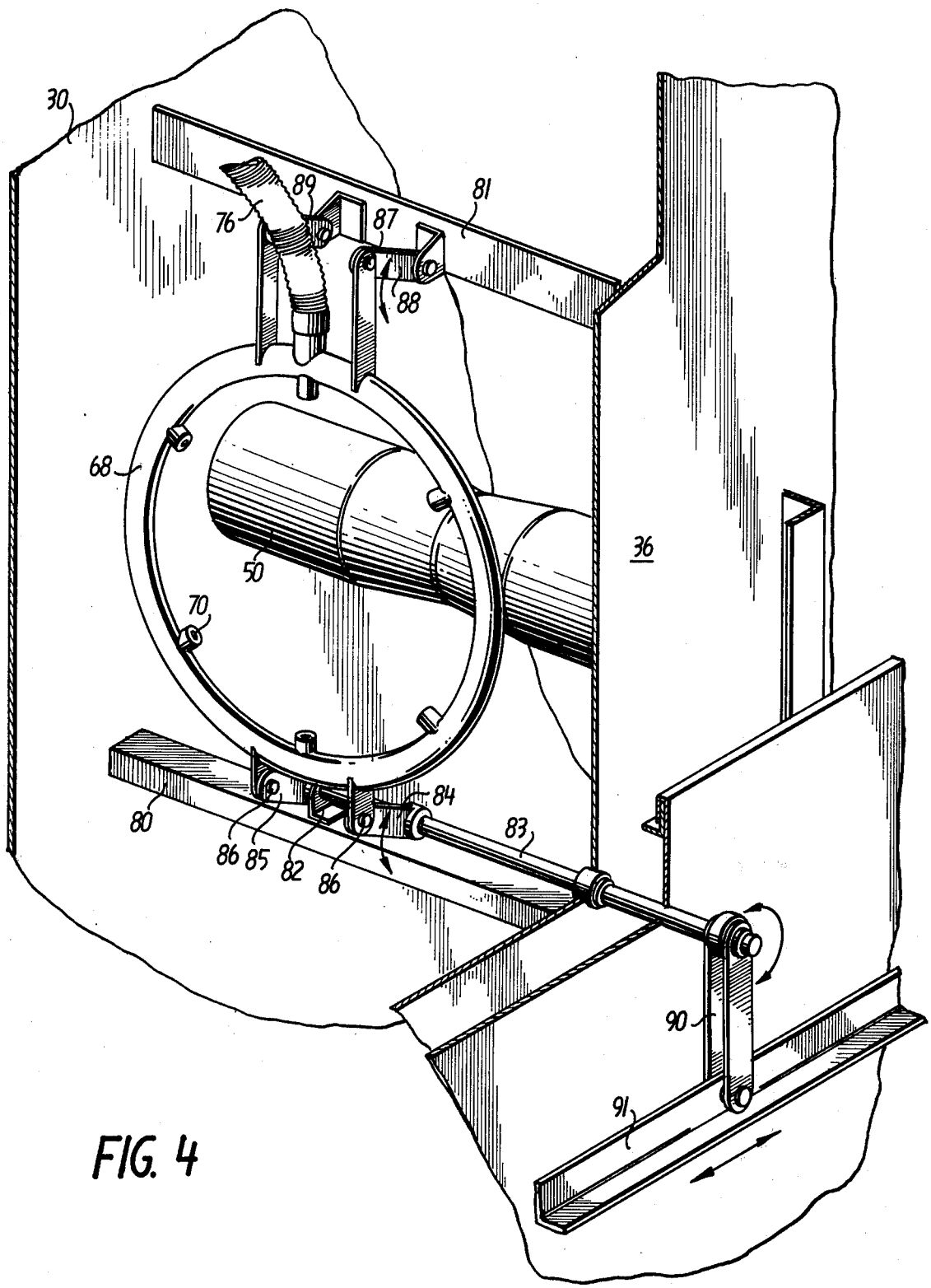
FIG. 4 is an enlarged fragmentary perspective view of a portion of the quench chamber, and depicts one of the vertically adjustable spray rings mounted therein and further details of the adjusting linkage.

As seen most clearly in FIGS. 3 and 4, each of the spray rings 68 is mounted within the quench chamber 28 on suitable transverse supports 80, 81. The lower supports 80 carry bracket members 82 in which one end of a rotatable shaft 83 is suitably journalled. The shafts 83 are also suitably journalled in one of the side walls 36 of the housing 30. The rotatable shafts 83 carry crank members 84, 85 upon which the spray rings 68 are pivotally secured at the lower ends thereof through pins 86.

The upper ends of the spray rings 68 are similarly pivotably connected through pins 87 to crank members 88, 89 pivotably mounted on the upper transverse support 81. It should be apparent, therefore, that rotation of the shaft 83, in a manner to be described hereinafter, causes vertical movement of the spray rings 68, constrained to a vertical attitude by means of the pivotable crank members 84, 85 and 88, 89. The flexible hoses 76 connecting the spray rings 68 to the T-connecting pipes 74 will, of course, accommodate the movements of the spray rings 68.

The ends of the rotatable shafts 83 extending outwardly through the side wall 36 carry crank members 90 the other ends of which are pivotably connected to an L-shaped channel member 91.

Figure 5:
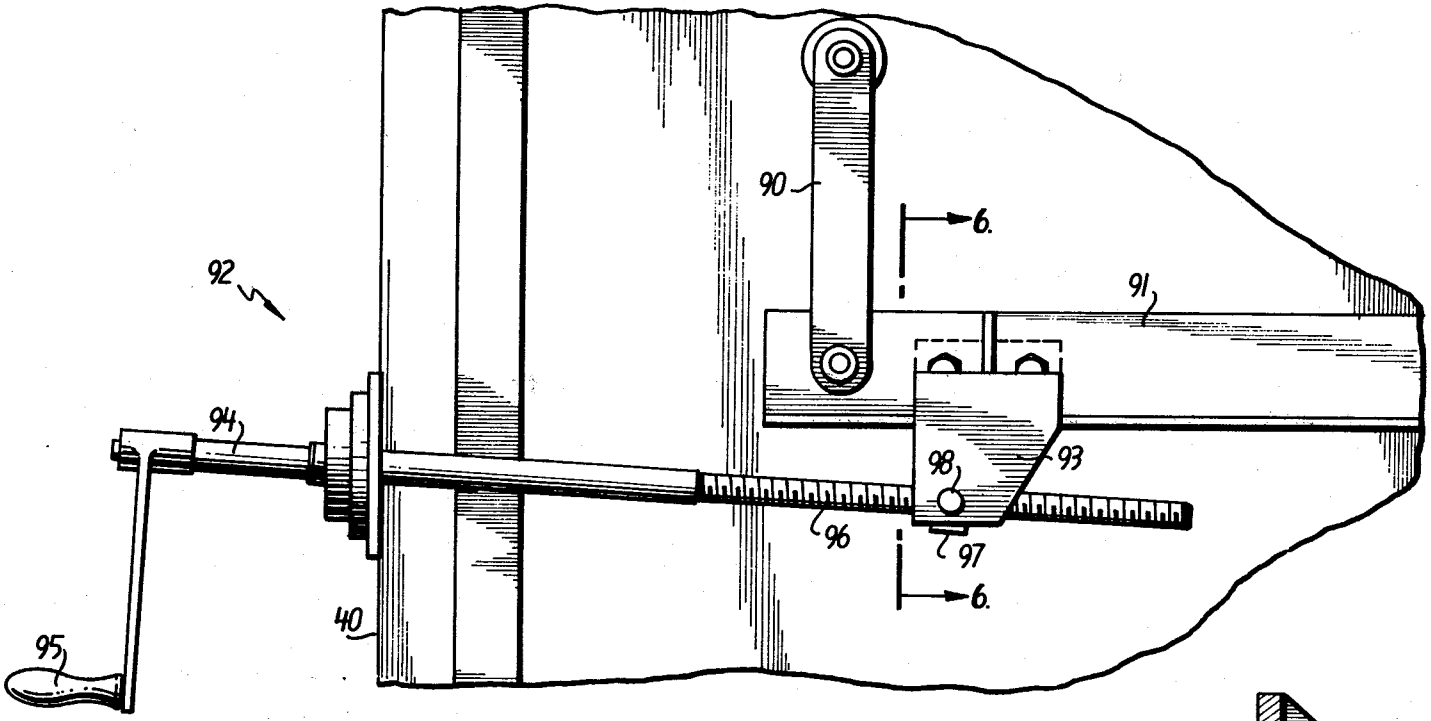
FIG. 5 is an enlarged fragmentary elevation view of the operating means for the adjustable linkage.
Figure 6:
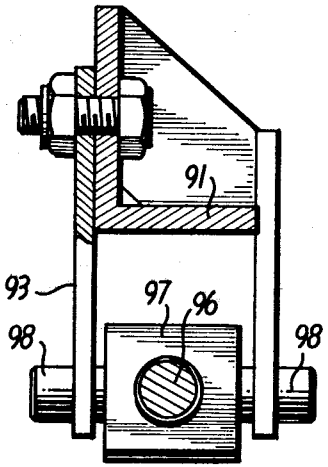
FIG. 6 is a sectional view taken along line 6—6 of FIG. 5, and depicts further details of the adjusting linkage.

As seen most clearly in FIGS. 3 and 5, the channel member 91 is connected to an operating mechanism 92 through a suitable bracket 93 carried by the channel member 91. The operating mechanism 92 includes a rotatable shaft 94 suitably journalled in the end wall 40 of the quench chamber housing 30. One end of the shaft 94 carries a handle 95 for rotating the same, and the other end of the shaft 94 includes screw threads 96 interconnected with a trunnion nut 97 suitably journalled in the bracket 93 by means of pins 98. It should be apparent, therefore, that rotation of the shaft 94 causes translation of the trunnion nut 97 therealong, thereby effecting translation of the channel member 91. Because of the pivotable mounting of the trunnion nut 97, a slight arcuate movement of the channel member 91 accompanies its translation along the axial extent of the quench chamber 28.

When it is desired to vary the vertical position of the spray rings 68 in order to position them concentrically with the longitudinal axes of billets of different diameters passing therethrough along the rollers 50, the hand wheel 95 is turned to rotate the shaft 94, thereby effecting translation of the channel member 91. Translation of the channel member 91 will effect rotation of the crank members 90 which, in turn, effect rotation of the shafts 83 to vary the vertical positions of the spray rings 68. An indicator means comprising a scale 99 and a pointer 100, carried by one of the crank members 90, may be provided so as to indicate the vertical position of the spray rings 68. The scale 99 may, of course, be calibrated as a function of the various billet diameters adapted to pass through the spray rings 68.

Referring once again to FIG. 9, it can be seen that after the billets B emerge from the quench chamber 28 they are delivered by the conveyor 48 to an outlet conveyor 104 having rollers 106 which advance the billets to a discharge transfer table 108 where suitable means are provided for removing the billets B from the conveyor 104 and rolling them out onto the table 108. As can be seen in FIG. 9, the rollers 106 of the outlet conveyor 104 are driven by the motor 64 by means of an endless chain 110. The chain 110 is, in turn, drivingly connected, through suitable means, to the chain 62 of the quench chamber conveyor 48. Similarly, the chain 62 is drivingly connected through a suitable transmission 112 to an endless chain 114 which drives the furnace discharge conveyor 26. It should be apparent, therefore, that each of the conveyors 26, 48 and 104 are interconnected to one another through suitable means and are thus all driven by the variable speed motor 64. Consequently, the variable speed drive motor 64 permits the billets B to be advanced continuously from the furnace 20 through the quench chamber 28, and out along the discharge conveyor 104 while allowing the predetermined quench time to be varied as a function of the billet diameter, metallurgical constituency, and temperature. This precise control of the quenching time, taken in consideration of the above-mentioned parameters, yields the low degree of warpage in accordance with this invention.

It should be apparent, therefore, that there is provided in accordance with this invention a novel tandem system for homogenizing and quenching metal billets, particularly aluminum billets that are intended to be subsequently processed in an extrusion operation. The continuous and rapid cooling of the billets afforded by the quench chamber 28 yields high production rates as well as billets having improved metallurgical properties. Moreover, the even and controlled cooling obtained by the adjustable spray rings 68 around the entire periphery of the billets results in minimum warp of the billets which further facilitates a subsequent extrusion operation. In this regard, it is further contemplated within the scope of the invention to have the billets rotate about their longitudinal axes as they are transported through the quench chamber 28. This may be accomplished by designing the hour-glass-shaped rollers 50 with a progressing degree of slant so that their configuration will cause the billets to rotate as they pass thereover. Such an arrangement would further facilitate even cooling of the billets and reduce the amount of warpage.

Although only a preferred embodiment of the invention has been specifically illustrated and described herein, it is to be understood that minor variations may be made without departing from the spirit of the invention.

It is claimed:

1. Apparatus for homogenizing and quenching cast metal billets comprising a furnace and a quench chamber disposed in contiguous relation thereto, conveyor means defining a path of travel for billets through said quench chamber, spray cooling means including a plurality of concentrically arranged continuously annular spray rings disposed in spaced relation along and surrounding said path of travel and adapted to have billets pass therethrough, said spray rings being connected to a manifold pipe adapted to supply cooling fluid to said spray rings, said conveyor means including a plurality of support rollers fixedly mounted in said chamber between successive ones of each of said plurality of annular spray rings for supporting the billets during quenching to thereby inhibit warpage thereof, and means for simultaneously adjusting the vertical position of each of said spray rings independently of said quench chamber and said support rollers so as to position said spray rings concentrically with respect to the axes of billets of different diameters supported on said support rollers and adapted to pass through said spray rings.

2. Apparatus as defined in claim 1 wherein said adjusting means includes a linkage interconnecting each of said spray rings, and means manually operable at one end of and externally of said chamber for operating said linkage to vary the vertical position of said spray rings.

3. Apparatus as defined in claim 2 wherein each of said spray rings is mounted on a rotatable shaft, said linkage including an elongated channel member extending and movable in a direction substantially parallel to said path of travel, and a plurality of crank members connecting each of said rotatable shafts to said channel member whereby actuation of said operating means will cause translation of said channel member, which in turn will cause said crank members to rotate said rotatable shafts, thereby varying the position of said spray rings.

4. Apparatus as defined in claim 3 wherein each of said spray rings is mounted on its respective rotatable shaft by means of a crank member, and guide means associated with each of said spray rings for constraining said spray rings in an attitude substantially perpendicular to said path of travel throughout the various vertical positions thereof.

5. Apparatus as defined in claim 2 including means associated with said linkage for indicating the vertical position of said spray rings, said indicating means being calibrated as a function of the various billet diameters adopted to pass through said spray rings.

6. Apparatus as defined in claim 1 wherein each of said spray rings is connected to said manifold type pipe by means of a flexible coupling for accommodating the vertical movement of said spray rings.

7. Apparatus as defined in claim 6 wherein said flexible coupling comprises a flexible hose.

8. Apparatus as defined in claim 1 wherein said rollers are hour-glass-shaped rollers, sprocket means associated with each of said rollers, and an endless chain cooperating with said sprockets and adapted to be driven for rotating said rollers and transporting billets through said quench chamber.

9. Apparatus as defined in claim 1, further including valve means associated with each of said spray rings for controlling the admission of cooling fluid thereto, each of said valve means being selectively operable to adjust the volume of fluid admitted into the respective spray rings whereby the degree of quench may be varied throughout said quench chamber.

10. Apparatus as defined in claim 1, further including normally closed solenoid-operated control valves for controlling the admission of cooling fluid from said manifold pipe into said spray rings, means for sensing the entry of a billet into said quench chamber, and means operatively connected with said sensing means for actuating said solenoid-operated control valves to admit cooling fluid into said spray rings when a billet enters said quench chamber.

11. Apparatus for homogenizing and quenching cast metal billets comprising a furnace and a quench chamber disposed in contiguous relation thereto, first conveyor means for transporting billets out of said furnace, second conveyor means for transporting billets through said quench chamber, third conveyor means for transporting billets from said quench chamber to a discharge transfer station, drive means interconnecting said first, second and third conveyor means, and means for varying the rate at which billets are conveyed through said quench chamber whereby the quench rate may be adjusted so as to minimize the degree of billet warp.

12. Apparatus as defined in claim 11 wherein said means for varying the rate at which billets are conveyed through said quench chamber comprises a variable speed motor drivingly coupled to at least one of said interconnected conveyor means.

13. Apparatus as defined in claim 11 wherein said first conveyor means is a discharge conveyor from said furnace.

14. Apparatus as defined in claim 11, further including a plurality of concentrically arranged spray rings disposed in spaced relation along and surrounding said second conveyor means for applying a cooling fluid to billets passing therethrough, and means for adjusting the vertical position of each of said spray rings concentrically with the longitudinal axes of billets passing therethrough, whereby the billets will be evenly quenched about the entire peripheral surfaces thereof thereby further minimizing the degree of billet warp.

* * * * *